United States Patent [19]

Deguerry

[11] Patent Number: 4,619,346

[45] Date of Patent: Oct. 28, 1986

[54] ELEVATOR-TYPE WORK PLATFORM

[75] Inventor: Louis Deguerry, Trevoux, France

[73] Assignee: Comabi S.A., Ain, France

[21] Appl. No.: 629,682

[22] Filed: Jul. 11, 1984

[30] Foreign Application Priority Data

Jul. 11, 1983 [FR] France ..... 83 11920

[51] Int. Cl.[4] ..... B66B 9/20

[52] U.S. Cl. ..... 187/9 E; 187/11; 182/152; 182/141

[58] Field of Search ..... 187/9 E, 11, 9 R, 1 R, 187/95; 182/152, 141, 147; 403/325, 327; 52/17, 18

[56] References Cited

U.S. PATENT DOCUMENTS

| | | | |
|---|---|---|---|
| 2,632,530 | 3/1953 | Wagner | 187/9 E |
| 2,910,203 | 10/1959 | Todd | 187/95 X |
| 3,378,101 | 4/1968 | Zeitler | 182/152 X |
| 3,515,243 | 6/1970 | Ellen, Jr. | 182/141 X |
| 4,000,789 | 1/1977 | Zahner | 182/152 |
| 4,458,785 | 7/1984 | Bushnell, Jr. | 187/9 E |

*Primary Examiner*—Joseph J. Rolla
*Assistant Examiner*—Nils E. Pedersen
*Attorney, Agent, or Firm*—Karl F. Ross; Herbert Dubno

[57] ABSTRACT

An elevator has a horizontal chassis, a telescopingly extensible and retractable mast having upper and lower ends, a guide extending along the mast between its ends, and a platform adapted to support a worker and displaceable in the guide along the mast between its ends. The lower end of the mast is pivoted on the chassis for movement of the mast relative to the chassis between an erect position with the upper end above the lower end and a recumbent position with the mast lying on the chassis and the mast ends generally level with each other. This axis is sufficiently above the chassis that in the recumbent position the platform can lie between the chassis and the mast. The chassis has opposite ends, one of which carries the mast and pivot. The center of mass of the mass is horizontally between the pivot axis and the other chassis end so that a drive connected between the chassis and the mast first pivots the mast about the axis from the recumbent to the erect position and then vertically extends the mast and raises the platform. This drive is normally a motor mounted on the chassis and having a drum and a cable connected between the drum and the mast.

17 Claims, 28 Drawing Figures

FIG.24
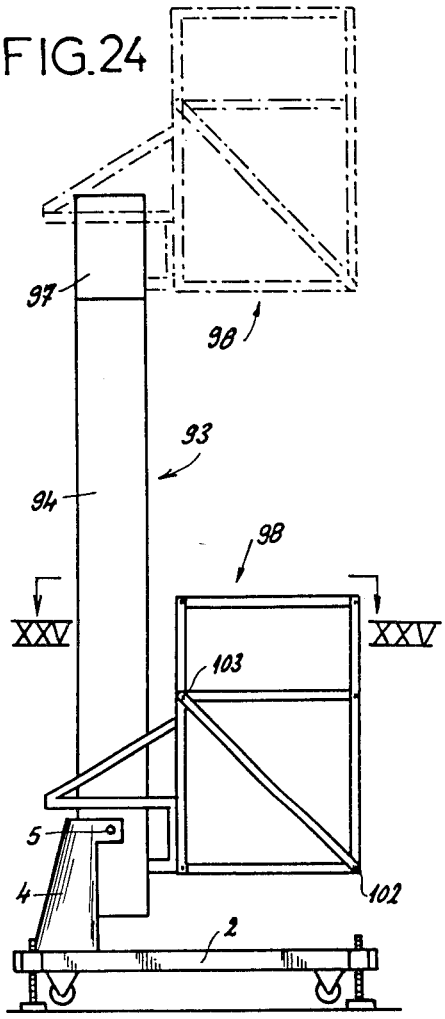
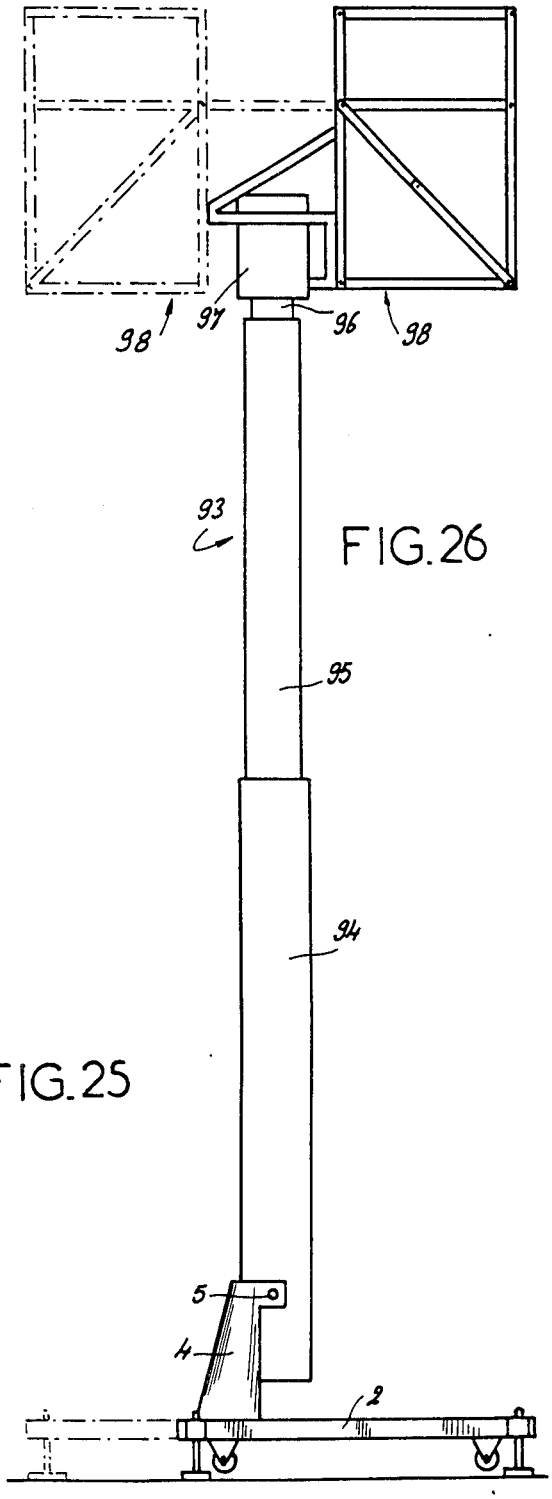
FIG.26
FIG.25
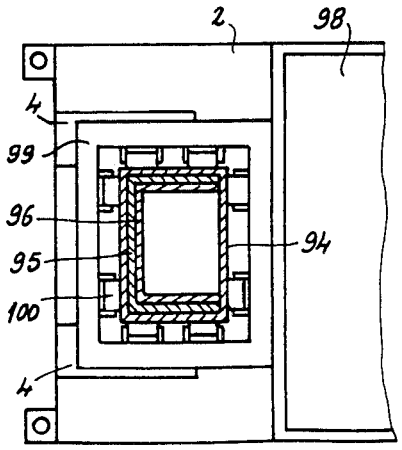

ELEVATOR-TYPE WORK PLATFORM

FIELD OF THE INVENTION

The present invention relates to a lift. More particularly this invention concerns an elevator-type work platform.

BACKGROUND OF THE INVENTION

In order safely to work well above the floor, for instance doing regular maintenance such as cleaning glass or changing light bulbs, it is necessary to have a platform big enough for the worker or workers that it will carry, and mechanism to raise it up to the working level and hold it steadily there once raised. Such a piece of equipment must be very stable, especially as it is normally used a great deal and under difficult conditions.

The platforms of these devices are normally liftable to a height that is a multiple of its starting height, a standard unit having a platform height that is 6'10" at minimum and 28'2" at maximum. The minimum height is mainly dictated by the doorway size the equipment must fit through.

Thus the lifting mechanism must be able to fold up to a fairly small size. In standard lever arrangements, in particular of the lazy-tongs type, the folded up lifting mechanism, whether operated by a motor or by a winch, is very bulky. In addition such mechanisms are quite expensive to produce, as they must support heavy loads, withstand substantial torques, and at the same time fit snugly together when down.

Hence recourse is had to a telescoping mast to support such a platform. These arrangements can fold up in a very compact manner, but nonetheless are expensive to build and service. They can also be very heavy, in particular in hydraulic models.

Two-mast hydraulic arrangements, which can support relatively large platforms, are particularly difficult to use. For transport the two masts are pivoted horizontal over the platform and chassis, requiring that this chassis be asymmetrical as the one pivot must be above the other so the one mast can lie atop the other. To raise the platform it is necessary to pivot up and lock both these masts, secure the platform in place, deploy the leveling jacks and/or outriggers, and only then can the platform be raised.

OBJECTS OF THE INVENTION

It is therefore an object of the present invention to provide an improved lift-type working platform.

Another object is the provision of such a lift-type working platform which overcomes the above-given disadvantages, that is which is of relatively simple construction, which is easy to set up and knock down, and which is at least as safe and stable as the prior-art systems.

SUMMARY OF THE INVENTION

An elevator according to the invention has a horizontal chassis, a telescopingly extensible and retractable mast having upper and lower ends, a guide extending along the mast between its ends, and a platform adapted to support a worker and displaceable in the guide along the mast between its ends. The lower end of the mast is pivoted on the chassis for movement of the mast relative to the chassis between an erect position with the upper end above the lower end and a recumbent position with the mast lying on the chassis and the mast ends generally level with each other. This axis is sufficiently above the chassis that in the recumbent position the platform can lie between the chassis and the mast. Thus the collapsed system can be quite small, while still being very stable when erected.

According to this invention the chassis has opposite ends, one of which carries the mast and pivot. The center of mass of the mast is horizontally between the pivot axis and the other chassis end so that a drive connected between the chassis and the mast first pivots the mast about the axis from the recumbent to the erect position and then vertically extends the mast and raises the platform. This drive is normally a motor mounted on the chassis and having a drum and a cable connected between the drum and the mast.

The mast of this invention is normally formed of interfitting inner and outer elements having respective upper and lower ends, although three or more elements can also be used. The drive can also include deflector wheels at the upper and lower end of each element, in which case the cable passes over and under these wheels and has an end attached to the platform. Thus winding in the cable raises the platform and thereafter pulls up the mast elements. In such an arrangement the guide can be in part on the inner element and in part on the outer element. Similarly the chassis can have a guide portion underneath the guide and aligned therewith in the erect mast position.

It is also possible for the multielement mast to be operated by one cable that passes over the wheel of the outer element and has an end attached to the lower end of the inner element, and by another cable having one end connected to the upper end of the outer element, passing over the wheel of the inner element, and having an other end connected to the platform. In this arrangement, winding in the cable raises the platform and generally simultaneously extends the mast.

For erection and laying down of the mast by the same drive, a deflector wheel is provided outboard of the mast so that winding in the cable erects the mast before extending it.

In accordance with another feature of this invention a latch is provided on the mast and chassis for blocking extension of the mast except when in the erect position. This latch is typically a locking bolt engageable through the mast elements, and an actuator on the chassis for pushing it out of such engagement when the mast is erect. The latch also has a spring urging the locking bolt into engagement through the mast elements. The actuator can be a simple abutment engageable with the bolt opposite to the direction of the spring force in the erect position of the mast. Thus as the mast moves into the erect position the bolt is pushed by the abutment out of engagement through aligned holes in the mast elements, freeing them to move relative to one another.

A manually releasable second latch can block the mast from pivoting on the chassis when in the erect position. This second latch can also act on the first-mentioned latch to unblock the mast after same is in the erect position and the second latch has blocked pivoting of the mast, adding a second level of safety.

According to yet another feature of this invention, the chassis has two opposite ends each provided with one such mast and the axes of the masts are generally parallel but the masts are offset axially relative to each other so they can lay next to each other in the recumbent position. Thus even a heavy duty two-mast system can be folded down to very small size. Such an arrangement can be provided with crutches connectable to the lower ends of the masts and rigidly securable thereto. These crutches extend in the recumbent position horizontally past the chassis and in the erect position downward past the chassis. Thus pivoting of the masts from the recumbent to the erect position lifts the chassis up by means of the crutches. The crutches have outer ends provided with rollers and are also securable in the erect mast position to the chassis. In this manner when secured to the chassis and disconnected from the masts same can be moved into the recumbent position without dropping the chassis.

The platform of this invention is provided with carriages riding in the guides and is pivoted on these carriages about axes parallel to the mast pivot axes. The drive means has two cables connected to these carriages. In addition a lost-motion slide joint can be provided between the cable end and the platform for permitting limited raising of the platform relative to the cable end. This permits some movement of the platform as the masts are moving into and out of the recumbent position, as the platform pivots are not coaxial with the mast pivots.

DESCRIPTION OF THE DRAWING

The above and other features and advantages will become more readily apparent from the following, reference being made to the accompanying drawing in which:

FIG. 24 is a side view of a fourth elevator according to the invention in the erect but retracted position;

FIG. 25 is a large scale horizontal section taken along line XXV—XXV of FIG. 24;

FIGS. 26 and 27 are side views of the fourth elevator in the erect and extended position and in the retracted and recumbent position, respectively.

SPECIFIC DESCRIPTION

Figure 1:
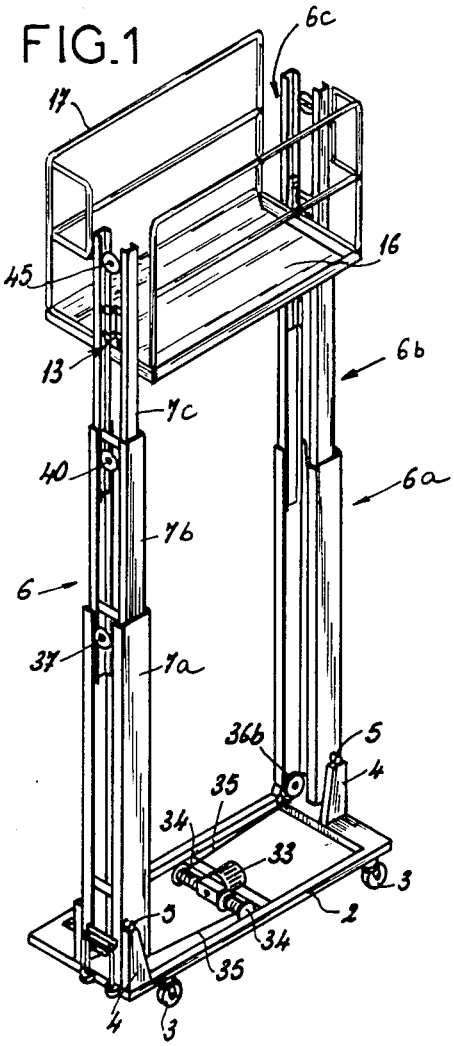
FIG. 1 is a perspective view of the elevator according to this invention with the masts upright and extended.
Figure 4:
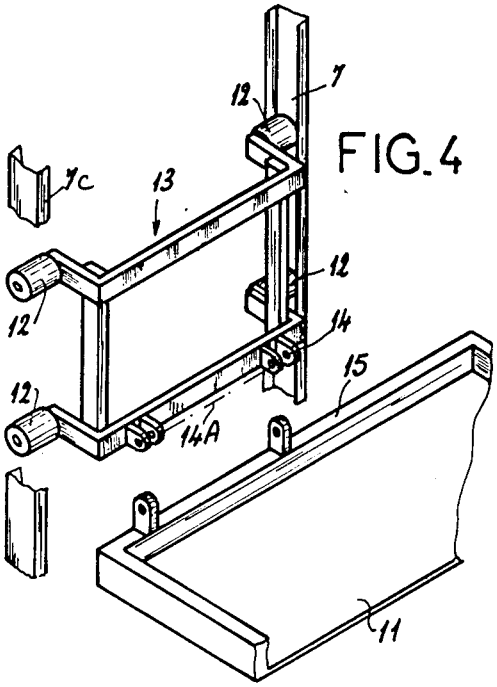
FIG. 4 is an exploded view of a detail of the elevator.
Figure 10:
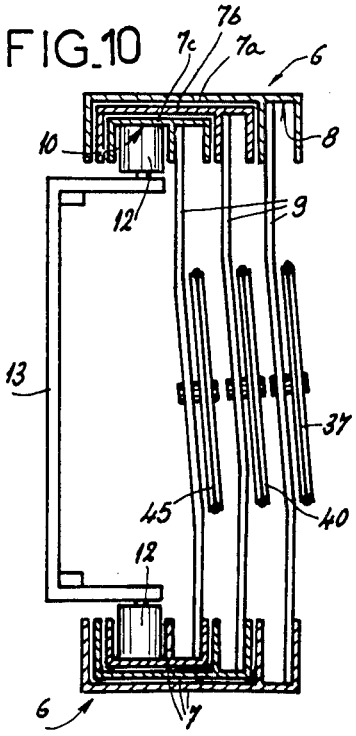
FIG. 10 is a large-scale horizontal section like FIG. 6 but at the very top of the mast.

As seen in FIGS. 1 through 9 an elevator has a base or chassis 2 that is of rectangular shape and whose upper surface 2*a* lies in a horizontal plane. This chassis 2 is supported on wheels 3, two of which swivel and two of which are fixed, although of course the arrangement could be incorporated in or mounted on a motor vehicle or trailer, depending on use. At each of its short ends the chassis 2 has a pair of supports 4 spaced apart transversely of the longitudinal direction of elongation of the chassis 2 and each carrying a pivot axle 5 centered on an axis 5A. The two axes 5A are parallel and equispaced above the surface 2*a*. The supports 4 are offset transversely, with one support of each pair on a respective one of the long sides of the chassis 2 and the other support of each pair near the middle of the respective short side of the chassis 2.

Each pair of supports 4 carries a mast 6 each in turn formed by three telescoping frames 6*a*, 6*b*, and 6*c* each formed in turn mainly of two respective telescoping profile-steel elements 7*a*, 7*b*, and 7*c*. These masts 6 are pivoted at the axis 5*a* on the axle 5, with the center of mass of each mast 6 being inward of its axis 5A, so that they naturally tend to pivot inward toward each other. The elements 7*a*, 7*b*, and 7*c* are of substantially the same asymmetrical W-section each with a narrow gap 8 between its center leg and one side leg, and a wide gap 10 between its center leg and other side leg. Two crosspieces 9, one at the top and one at the bottom of the respective mast 6, extend transversely of the chassis 2 and have outer ends fixed in the narrow gaps 8 at the top and bottom of each pair of elements 7*a*, 7*b*, and 7*c*, so to form them into the respective frame 6*a*, 6*b*, or 6*c*, the frames 6*b* of the elements 7*b* sliding in the wide gaps 10 of the elements 7*a* of the frames 6*a* and the frames 6*c* similarly sliding in the wide gap 10 of the elements 7*b* of the frames 6*b*. Thus each mast 6 can extend from the minimum-height down position of FIG. 2 to a maximum-height up position shown in FIG. 1, practically three times taller. Of course further telescoping elements would allow further incremental increases in vertical reach of the system.

Figure 7:
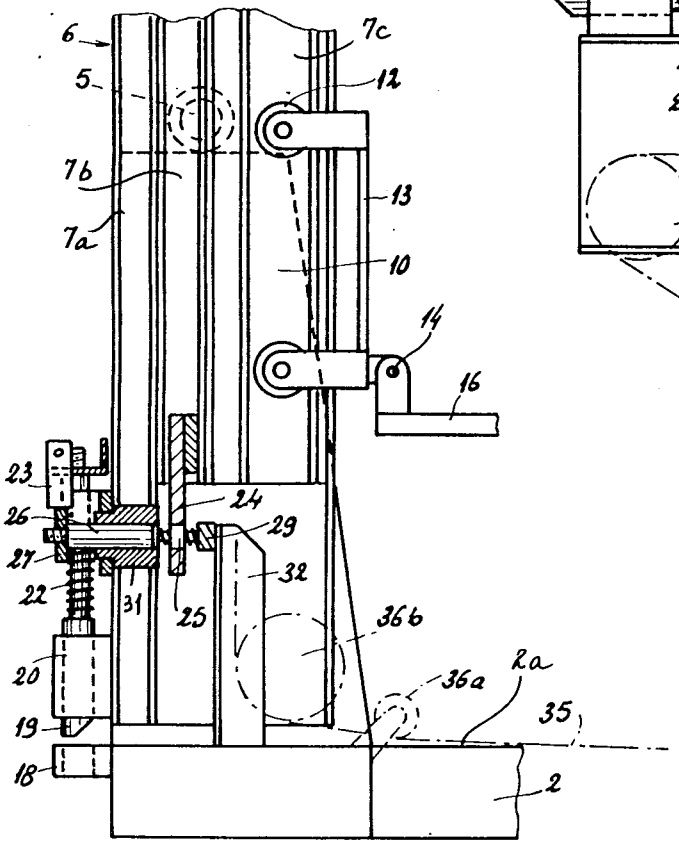
FIG. 7 is a partly sectional side view of a detail of the mast in the upright position.
Figure 9:
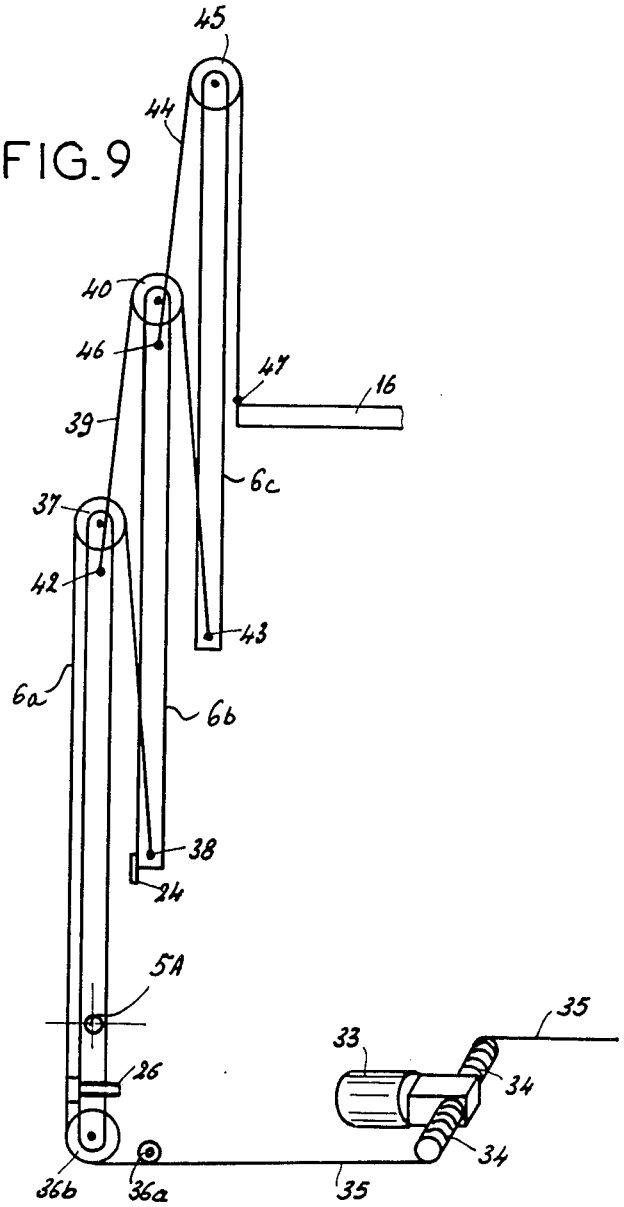
FIG. 9 is a small-scale and mainly schematic side view illustrating the cable connections for the mast of this invention.
Figure 11:
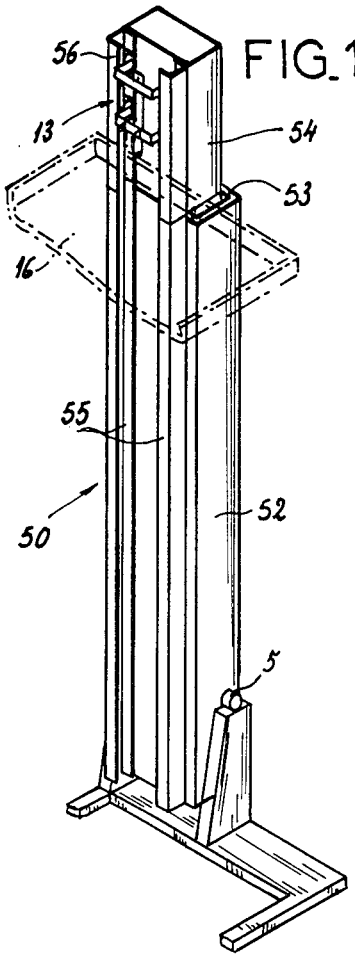
FIG. 11 is a partial view of a second such elevator according to this invention.
Figure 12:
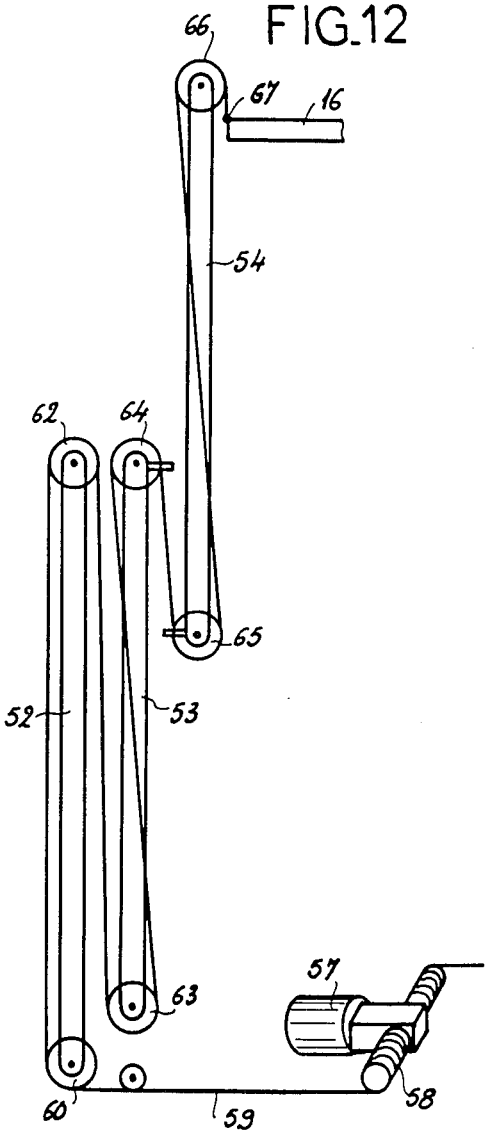
FIG. 12 is a view like FIG. 9 of the system of FIG. 11.
Figure 13:
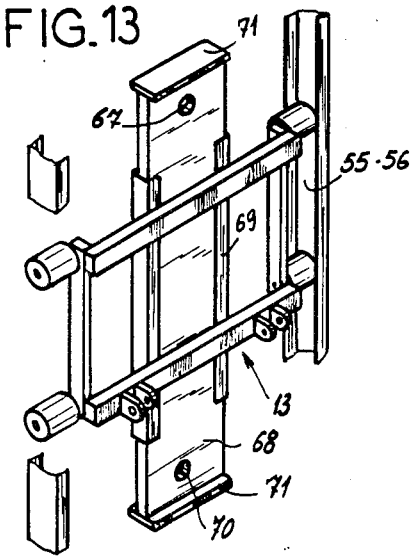
FIG. 13 is a partly broken-away view of a detail of the system of FIG. 11.
Figure 15:
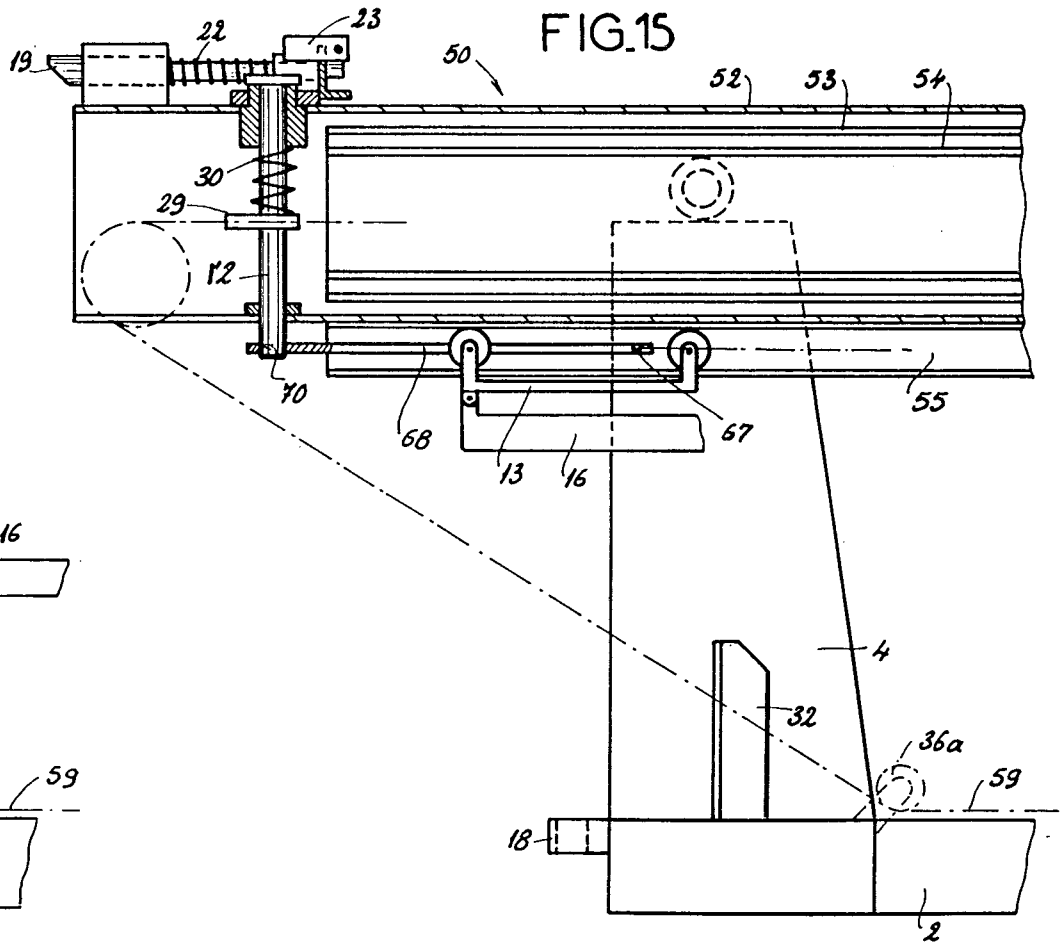
FIGS. 14 and 15 are views like FIGS. 7 and 8, respectively, of the system of FIG. 11 in the erect and recumbent position.
Figure 14:
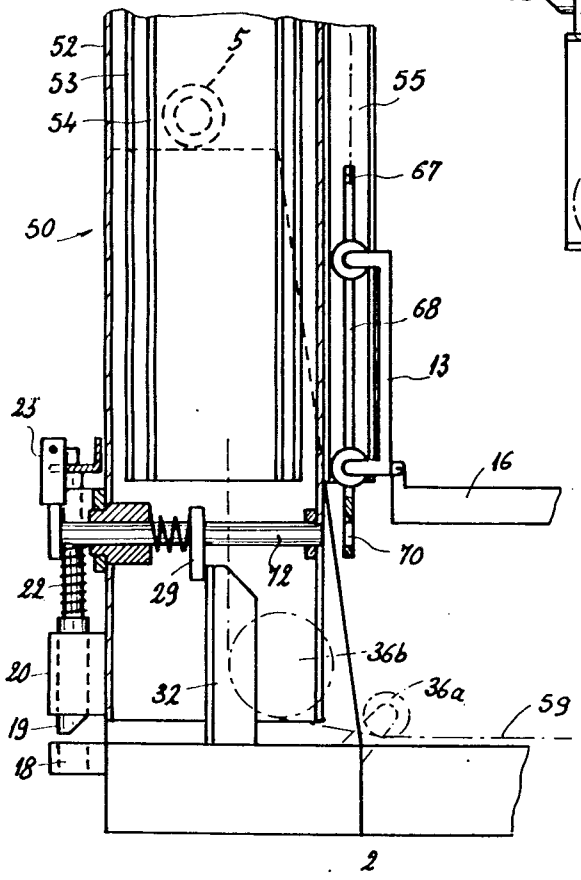

The wide gaps 10 of the inner elements 7*c* receive respective spaced pairs of rollers 12 mounted on respective trucks or carriages 13 connected by respective pivots 14 to the transverse ends of a platform 16. These pivots 14 define parallel axes 14A lying in a plane above and parallel to that of the axes 5A which in turn is above and parallel to that of the chassis surface 2*a*. The lower two rollers 12 of each carriage 13 are coaxial and, as shown in FIG. 7, generally level with the plane of the axes 14A, while the upper two rollers 12 of each carriage are also coaxial, but spaced toward the upper mast end therefrom. This platform 16 can therefore slide freely up and down in the inner frames 6c. The platform 16 is formed as a rigid floor 11 and a toe-board rim 15, and has a safety railing 17. As this platform 16 is suspended between the diagonally arranged masts 6 and the floor 11 is below the pivots 14, it is very stable.

Figure 5:
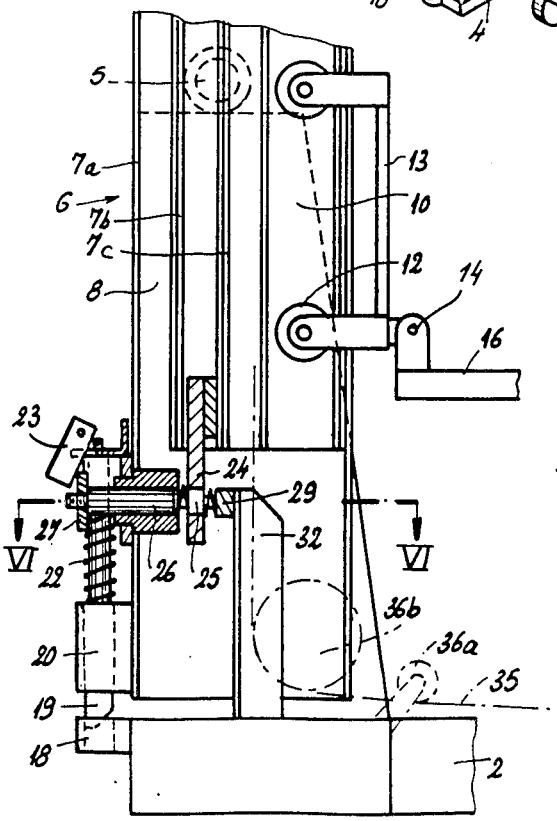
FIG. 5 is a large-scale section taken along line V—V of FIG. 2.

The chassis 2 is provided at each short end with two transversely spaced keeper eyes 18 in which are engageable bolts 19 vertically slidable in guide sleeves 20 of the respective elements 7a as shown in FIG. 5. The lower end of each of these bolts 19 is beveled toward the chassis, and a spring 22 urges each such bolt 10 downward. Thus as a mast 6 is swung counterclockwise about the axle 5 as seen in FIG. 5, the respective bolts 19 will latch in the respective eyes 18, positively and securely fixing the mast 6 in the upright position on the chassis 2. A manual release 23 is provided for lifting the two bolts 19 of each mast 6 into the unlocking position of FIG. 7 and thereby allowing the respective mast 6 to be swung down into the recumbent position of FIG. 3.

Figure 6:
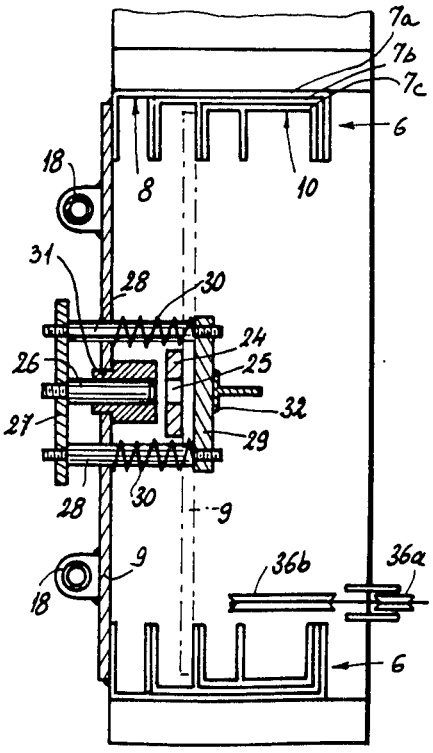
FIG. 6 is a section taken along line VI—VI of FIG. 5.
Figure 8:
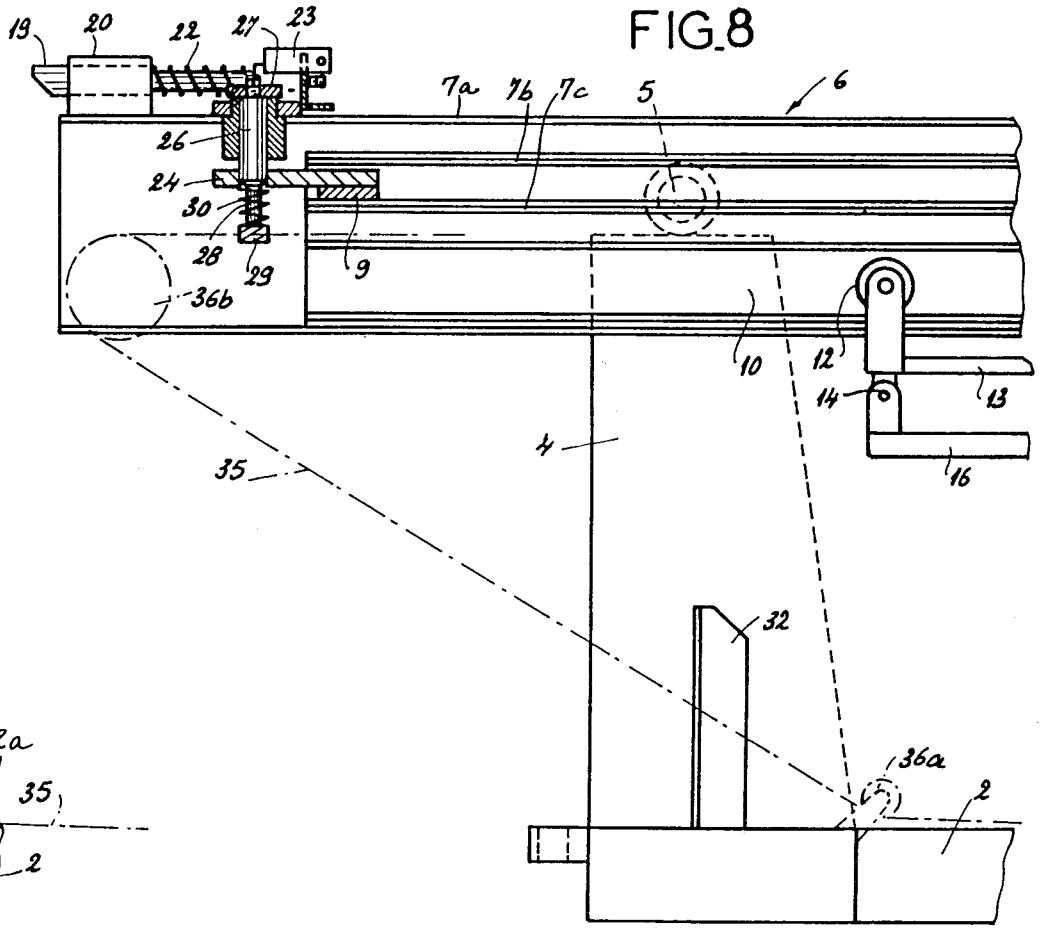
FIG. 8 is a view like FIG. 7 but with the mast horizontal.

In addition the lower crosspiece 9 of each intermediate frame 6b carries a plate 24 formed with an eye 25 as shown in FIGS. 5 and 7. The respective outer frame 6a carries a guide 31 through in which a rod 26 slides that can, in the lowered position, engage through the hole 25 and relatively lock the frames 6a and 6b together against relative sliding. As best seen in FIG. 6, this rod 26 has an outer end screwed into a plate 27 carried on two tie rods 28 that parallel flank the rod 26 and extend through holes in the lower outer strut 9 to where they are fixed in a plate 29. Springs 30 urge the pin 26 inward, that is toward the hole 25, but the chassis 2 carries at each end an abutment 32 that engages the respective plate 29 and pushes rod 26 away from the plate 24.

As a result the rod 26 can only be pushed out of the hole 25, thereby allowing the frames 6a and 6b of the respective elements 7a and 7b to slide relative to each other, when the respective mast 6 is perfectly upright. Under normal circumstances, when the masts 6 are all the way down before they are unlatched and pivoted in, this will automatically lock the outer two frames 6a and 6b of each mast 6 together.

Figure 2:
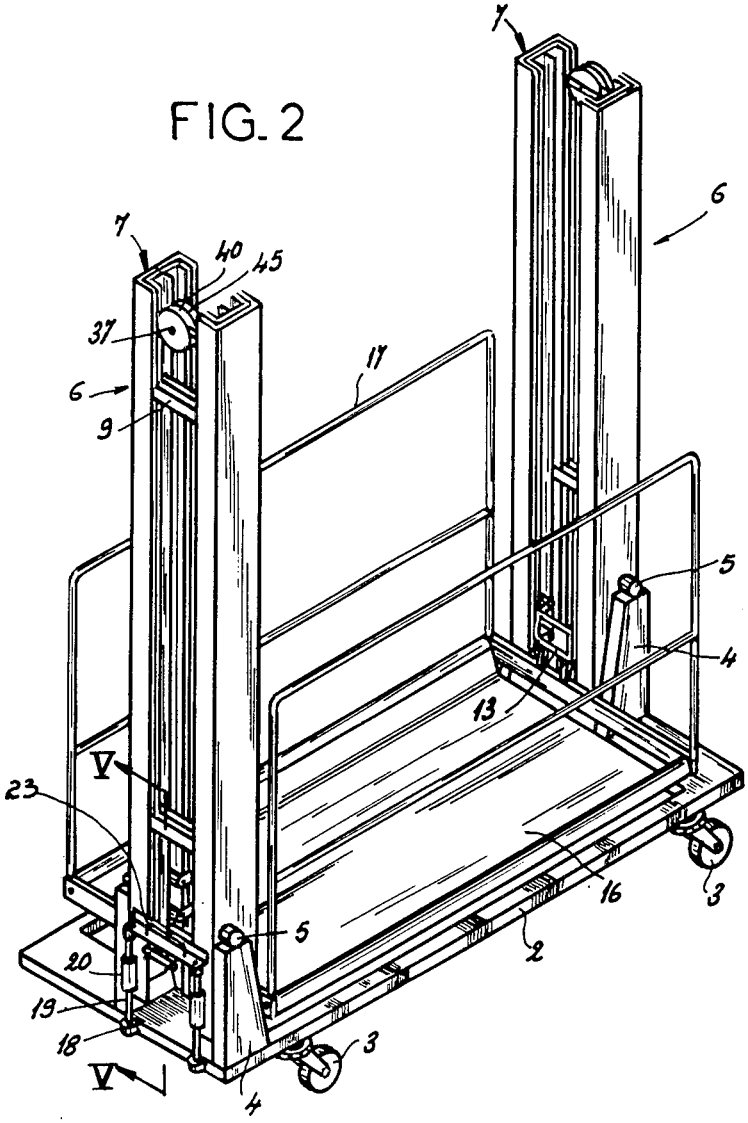
FIG. 2 is a perspective view of the elevator according to this invention with the masts upright but retracted.

The platform is raised in the upright position of FIG. 2 of the masts 6 by means of an electric motor 33 shown in FIG. 1 provided underneath the center of the device. This motor 33 carries two drums 34 on which are oppositely wound respective cables 33 for the respective masts 6. Each cable 35 passes under a small deflecting wheel 36a on the end of the chassis 2 and also under a larger such deflecting wheel 36b mounted on the inner face of one of the respective outer elements 7a. Thence each cable 35 passes up between the respective elements 7a to a wheel 37 (shown 90° twisted for clarity of view in FIG. 9) carried on the strut 9 of the upper end of this frame 6a, and then the cable 35 passes down and is fastened at 38 to the lower end of the middle frame 6b. Another cable 39 has one end connected at 42 to the upper end of the outer frame 6a, passes up and over a wheel 40 pivoted on the upper end of the intermediate frame 6b, and then passes down to attachment at 43 at the lower end of the inner frame 6c. A third cable 44 similarly passes from its one end 46 attached to the upper end of the intermediate frame 6b up and over a wheel 45 at the upper end of the inner frame 6c and is fastened to the respective truck 13 at 47.

As a result, rotation of the motor 33 in a direction to take in the cables 35 will raise the intermediate frames 6b at a rate exactly equal to the peripheral speed of the drums 34, and this will cause the cables 39 to raise the inner frames 6c at twice this speed, while the cables 44 move the platform 16 at twice this speed again. Everything will reach its uppermost end position at approximately the same time with appropriate dimensioning. Once the platform 16 is at the desired level, the user can climb up onto it, normally by some folding ladder not shown for clarity of view.

Reverse rotation of the motor 33 will oppositely drop the masts 6 down to the FIG. 1 position. If the latch bolts 19 have been pulled up, continued reverse rotation of the motor 33 after the masts 6 reach the retracted positions will allow them to pivot in until they are in the recumbent position of FIG. 3. During pivoting of the masts 6 from the erect to the recumbent positions, the carriages 13 in fact travel slightly along the respective inner frames 6c.

Figure 3:
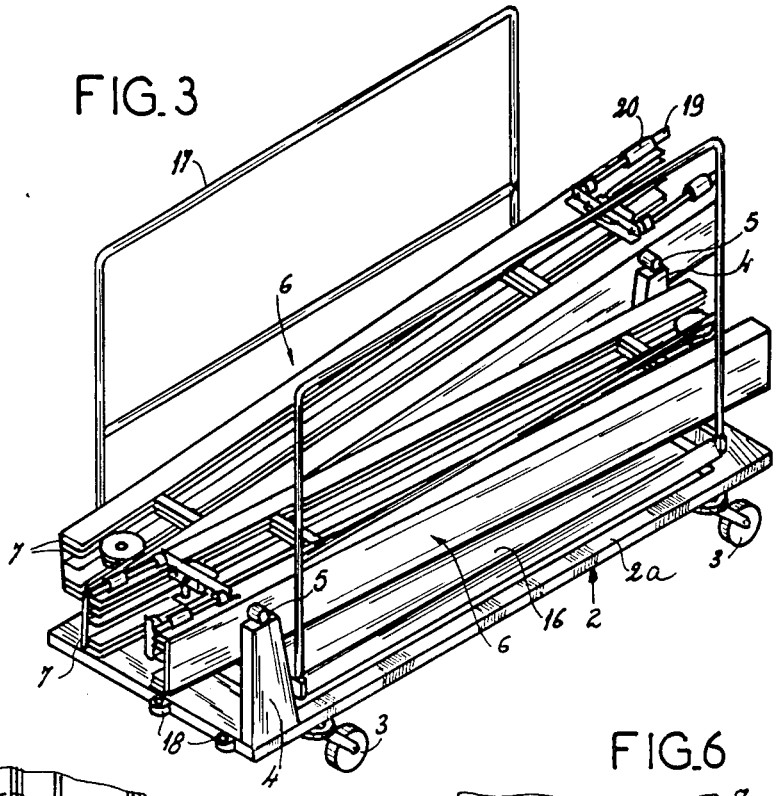
FIG. 3 is a perspective view of the elevator according to this invention with the masts lying down, in the transport position of the arrangement.

Conversely if the system is in the recumbent position of FIG. 3 and the motor is reversed in the forward direction, the first action will be for the two masts 6 to be pulled into the erect position, while remaining retracted due to the latch arrangement 25–32. Once the full-erect position is reached the bolts 19 will snap into the eyes 18 and the latch 25–32 will release the mast elements 7a–7c so the masts can extend upward.

The motor 33 can move the apparatus between all of its positions in either direction. The operator of the device need not do anything more than operate the latch releases 23.

In the recumbent transport position of FIG. 3 the two masts 6 are generally level with and adjacent each other, overlying the platform 16 that is under them. In fact in this recumbent position the platform 16 can remain suspended by the carriages 13 from the masts 6. The overall height of the thus collapsed device is very low, and can be decreased even further by removing the rails 17 which can normally be jerked up out of seat holes in the rim 15.

The mast 50 of FIGS. 11 through 15 is formed basically of an outer square-section box-beam element 52, a similar intermediate beam or element 53, and an inner element 54. The inner face of this element 52 is provided with a pair of channels 55 extending vertically parallel to each other, and the inner element 54 is substantially taller than the element 52 and carries two further such channels 56 identical to but shorter than these channels 55 and forming vertical continuations thereof. The carriage 13 can ride in these channels 55 and 56.

This system is controlled by a single cable 59 wound like the cable 33 on one of two drums 58 of the electric drive motor, but passing over deflecting wheels 60, 62, 63, 64, 65, and 66 at the bottoms and tops of the elements 52, 53, and 54, respectively, to attachment at 67 to the platform 16. Such single-cable guiding ensures that when the cable 59 is wound in by the motor 57 the first thing to move will be the platform 16 which will be pulled up to the top into the guide channels 56. Further winding-in will lift the inner element 54 to its fully extended position, and further winding in will similarly extend the intermediate element 53. Paying out the cable 59 will result in opposite movement, with the element 53 retracting before the element 54 and the platform 16 only dropping when the mast 50 is completely lowered.

A plate 68 slidable in a guide 69 on the respective carriage 13 is formed at its upper end with the attachment hole 67 and at its other end with a locking hole 70. This plate 68 has crosspieces 71 at its upper and lower ends so it cannot pull out of the guide 69 and therefore forms a lost-motion coupling between the cable 59 and the platform 16. The bolt 26 of FIGS. 1 through 10 is here replaced with an identically functioning bolt 72 that engages through the lower hole 70.

Thus when the mast 50 is moved out of the vertical or erect position, the rod 72 will pass through the hole 70 and prevent the carriage 13 from moving appreciably. Some sliding along the plate 68 is permitted to compensate for the offset from the axis of the pivot 5.

Figure 17:
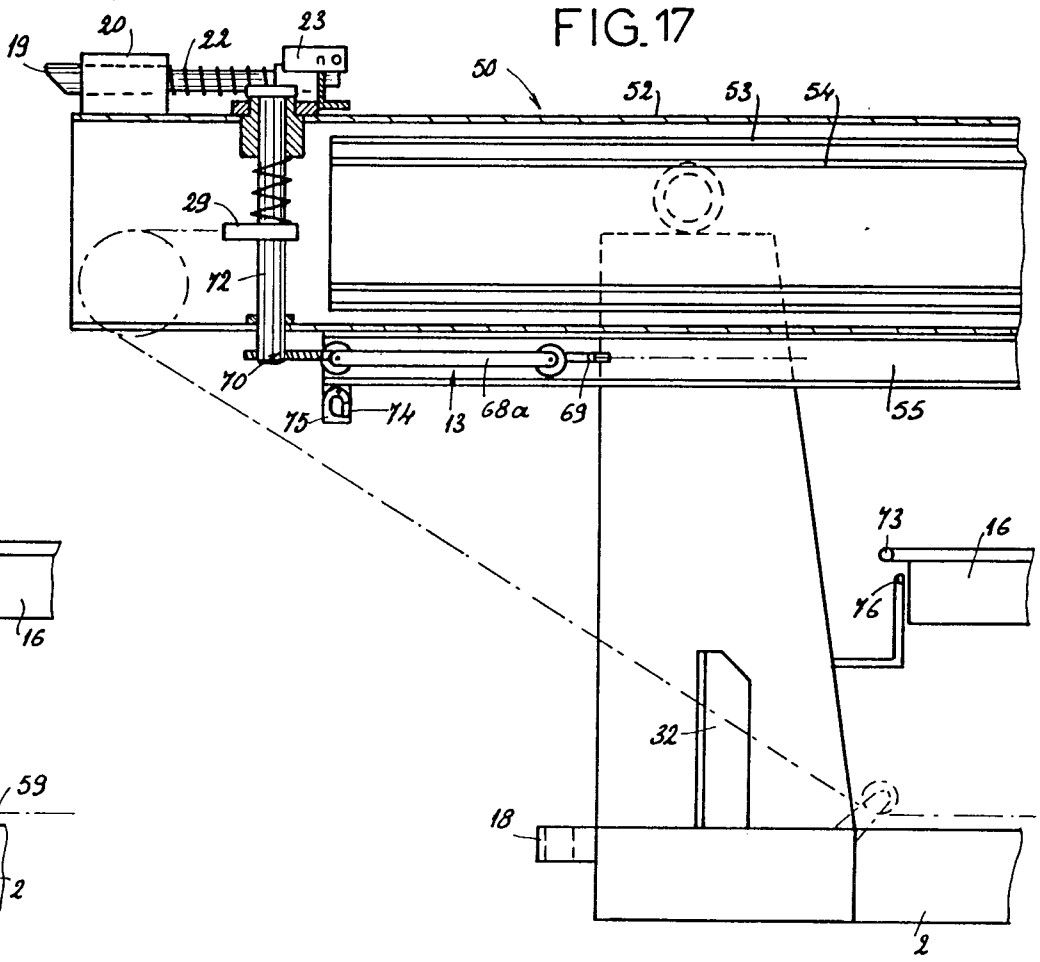
FIGS. 16 and 17 are views like respective FIGS. 14 and 15, but showing a variant on the arrangement of FIG. 11.
Figure 16:
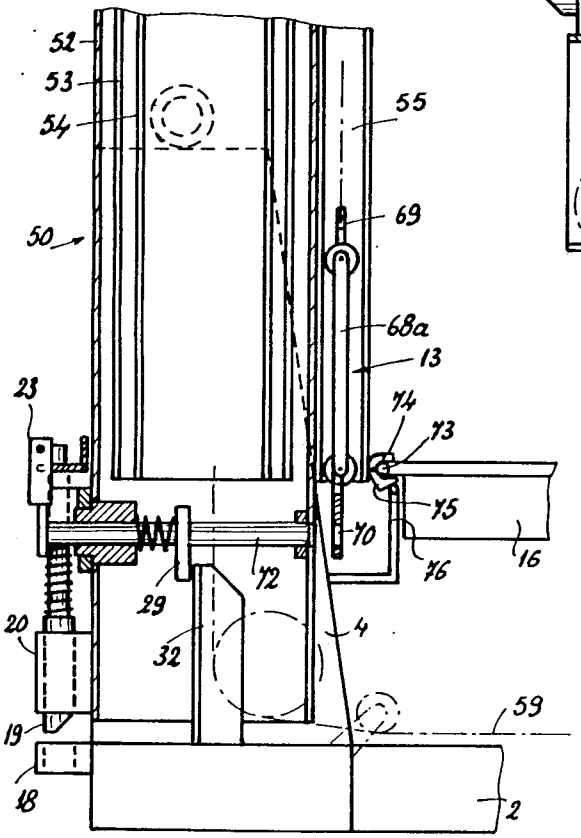

The arrangement of FIGS. 16 and 17 is substantially the same as that of FIGS. 11–14 except that the platform is provided at each end with a rod 73 that can engage in eyes 74 carried on a plate 68*a* equivalent to the plate 68 but provided with latches 75 that can be opened by abutments 76 on the supports 4. Thus when the platform 16 is lowered all the way down it is uncoupled from the masts 50 and sits on the abutments 76. Raising of the masts from the recumbent to the vertical position automatically couples the carriages 13 to the platform 16.

Figure 19:
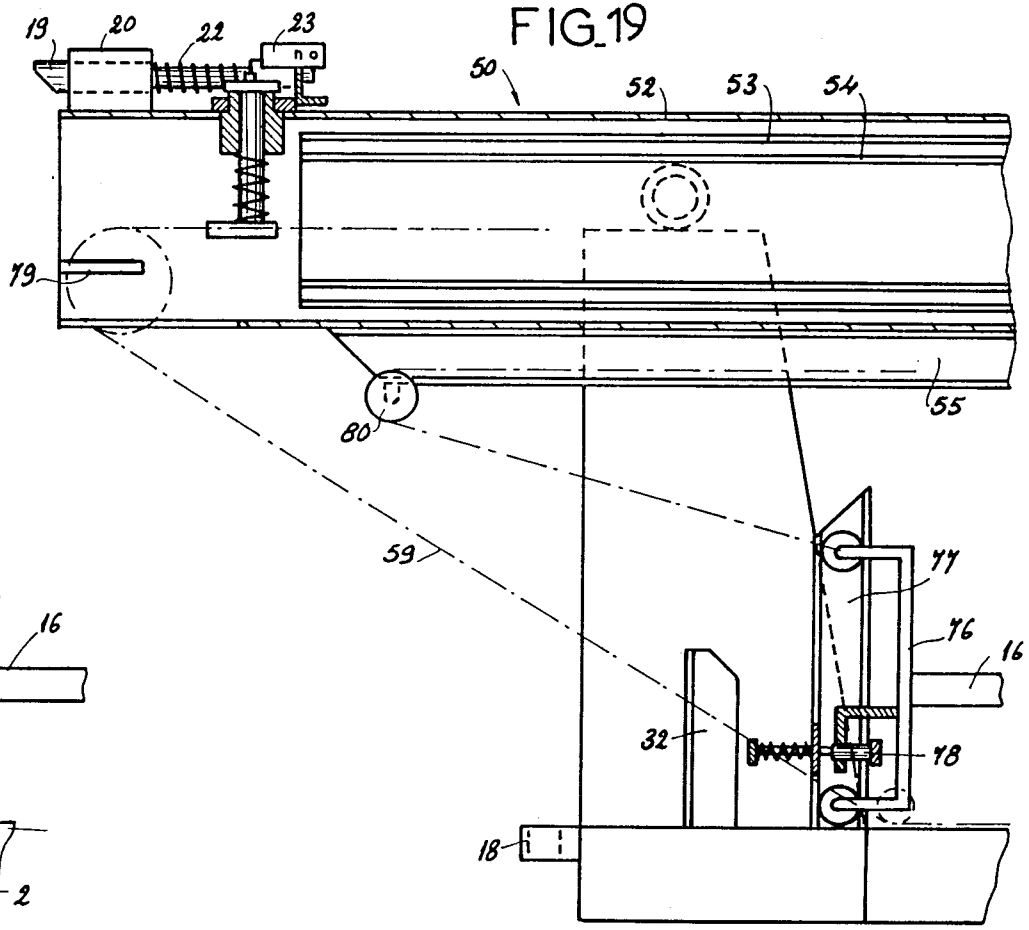
FIGS. 18 and 19 are also views like respective FIGS. 14 and 15, but showing another variant on the arrangement of FIG. 11.
Figure 18:
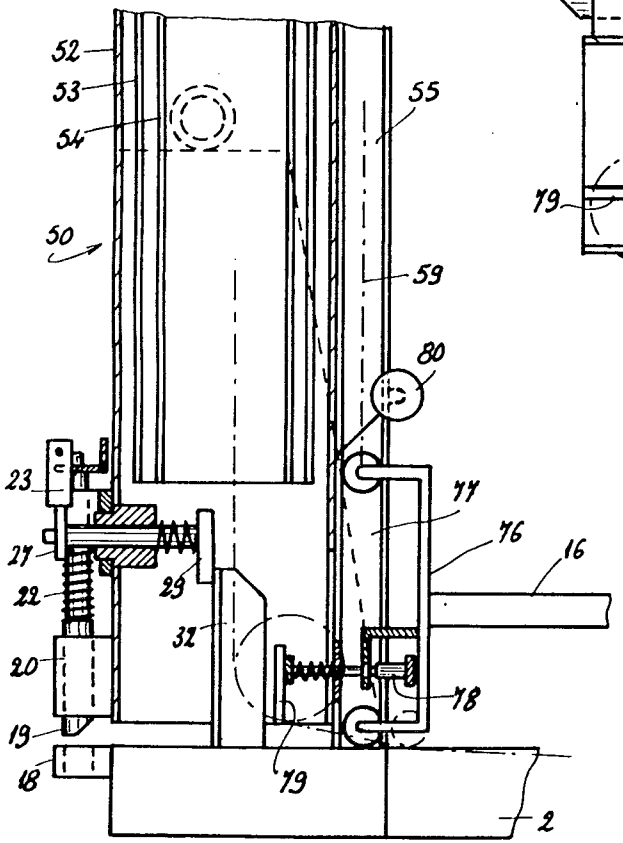
Figure 20:
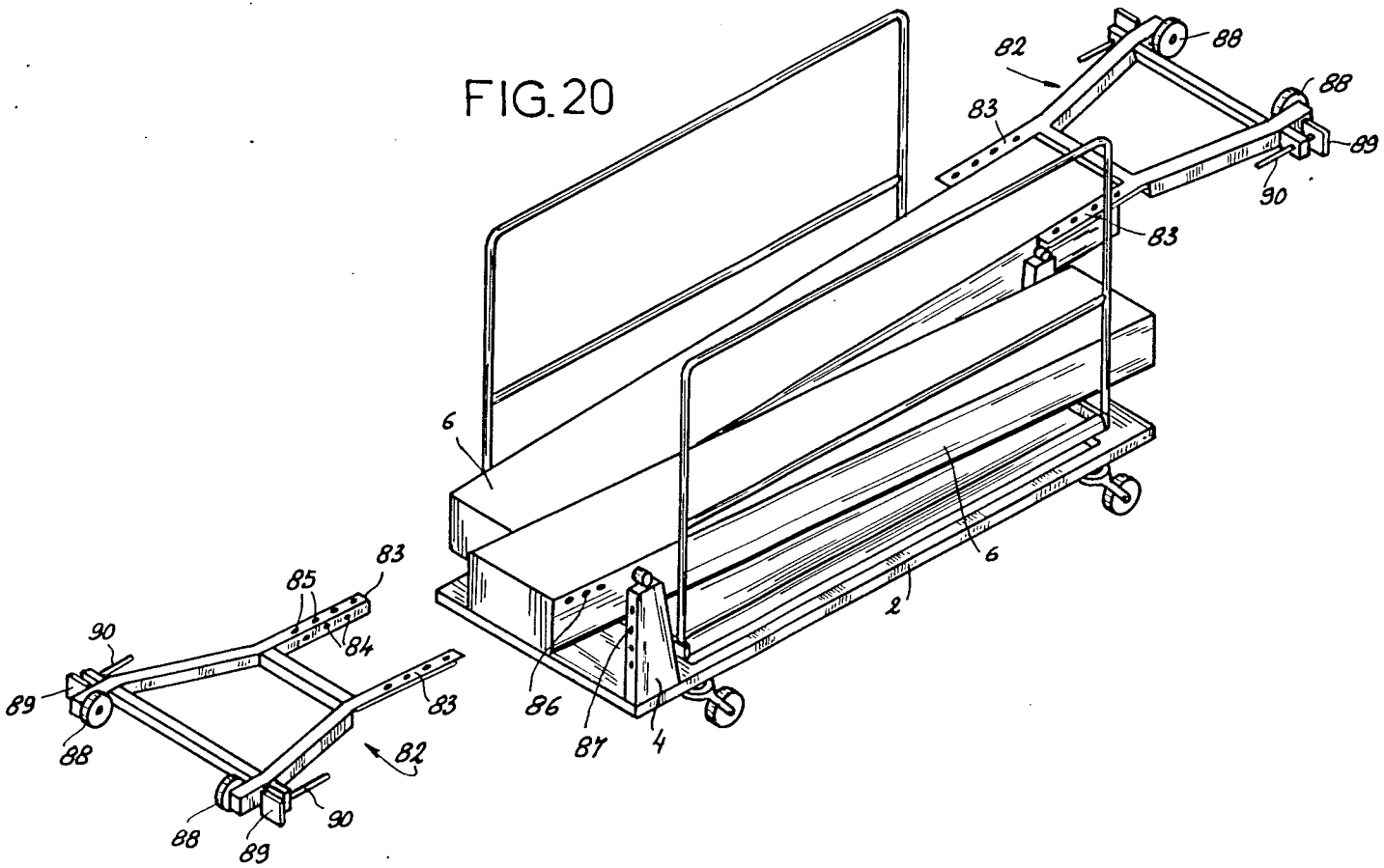
FIG. 20 is a perspective view of a third elevator according to the present invention.

In FIGS. 18 and 19 again the same references as FIGS. 11 through 15 are used for identical parts. Here the chassis 2 is provided with fixed lower guide-rail sections 77 that form in the vertical position downward extensions of the rails 55. In addition the platform 16 is fixed nonpivotally to carriages 76 lockable by a pin 78 coacting with an abutment 79 on the mast 50. Thus when lowered all the way down, the platform will be stationary on the chassis with its carriages 76 in the rail sections 77. As soon as the masts 50 pivot from the full-erect position, the lock pins 78 secure the carriage 16 solidly in place. A further deflector roller 80 is provided on the lower end of one of the rails 55 for the cable 59 in this arrangement.

Figure 21:
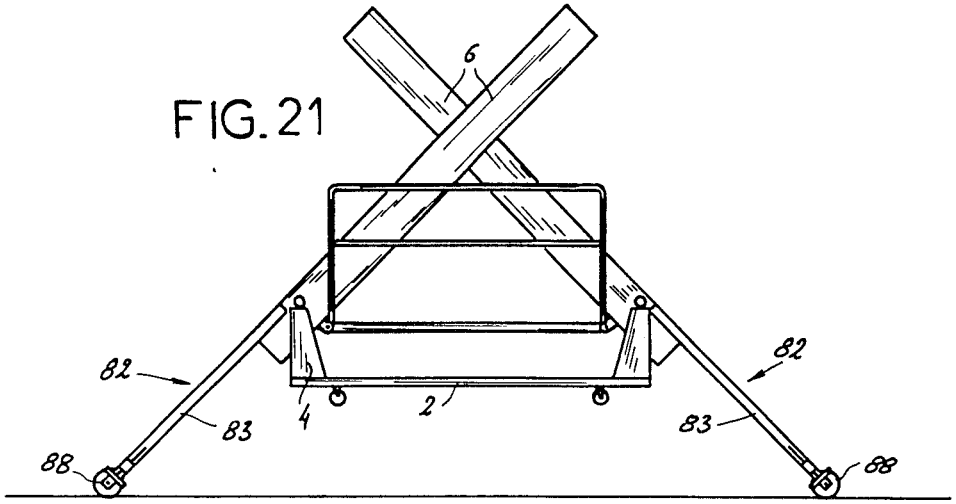
FIGS. 21, 22, and 23 are small-scale side views of the apparatus of FIG. 20 in three different positions.
Figure 22:
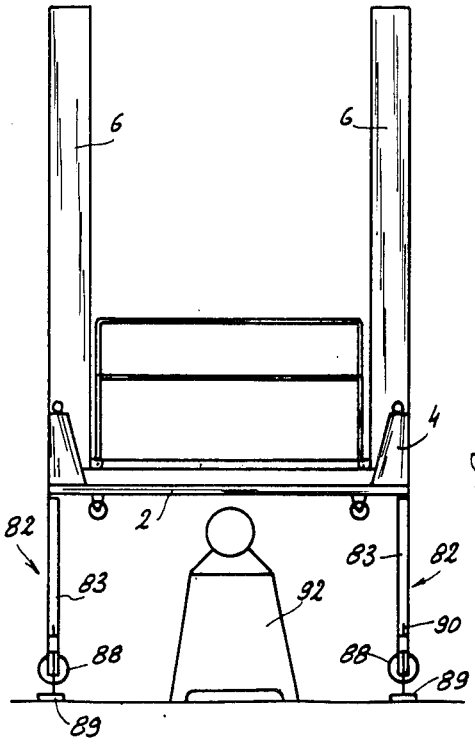

The arrangement of FIGS. 20 through 23 is basically identical to that of FIGS. 1 through 10, except that it is specially set up for use in locations where it is impossible to position the device directly under the place to be worked at, as for instance over a piece of equipment shown at 92 in FIG. 22. This is the type of situation that exists in a manufacturing or selling operation where the ceiling lights or the like must be worked on.

To this end the system is provided with two identical crutches 82 having upwardly extending arms 83 provided with bolt holes 84 by means of which they can be secured to the lower ends of the masts 6, and with further holes 85 by means of which they can be secured at holes 87 of the supports 4. Each crutch 82 has a lower end provided with two coaxial wheels 88 and a short jack foot 89 having a spindle 90.

In use the two crutches are secured at the holes 84 to the masts 66 which are then raised as indicated in FIG. 21 to lift the entire chassis 2 up until, as shown in FIG. 22, these crutches 82 are vertically aligned under the masts 6. In this position the jack feet 89 are lowered, and further outrigger jacks may also be deployed. In this position one can work directly above the obstacle 92.

Figure 23:
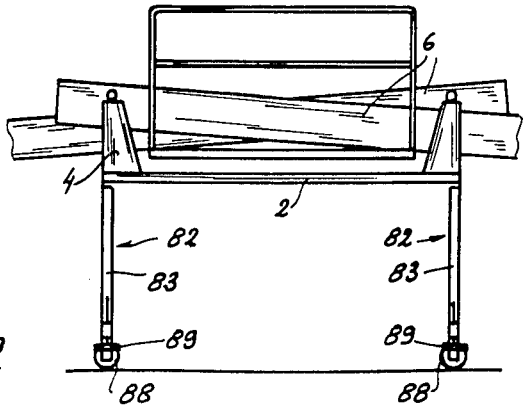

It is also possible in this raised position of the chassis 2 to insert bolts through the holes 85 into the holes 87 of the supports and to withdraw the bolts in the holes 84 and 86 so that with the chassis raised it is still possible to move the masts 6 into the recumbent position as shown in FIG. 23. Thus once the device is in the area where it is to operate, it is set up as shown in FIGS. 21 and 22, the masts 6 only being lowered to move it within the area, and the crutches 82 only being reattached to these masts 6 when the chassis 2 is to be set back down on the floor.

Figure 27:
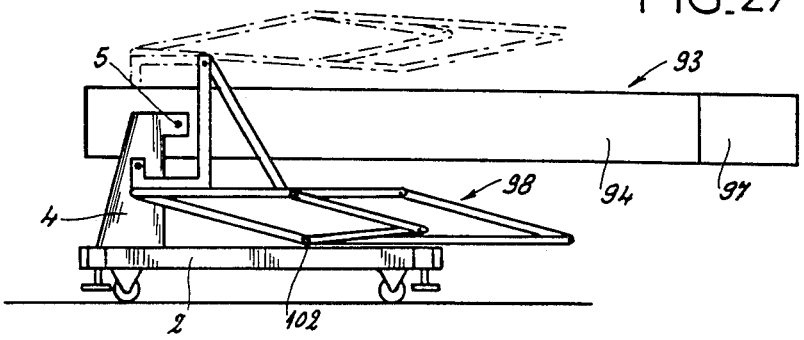

The arrangement of FIGS. 24 through 28 has a square-section mast 93 formed by a square section outer element 94 receiving two C-section elements 95 and 96, the latter carrying at its upper end a fitting 97 for supporting a platform or cage 98 that is provided with pivots 102 so it can fold up as shown in FIG. 27. The fitting is of the same size and shape as the outer tube 94 so that, when the system is collapsed or retracted as shown in FIG. 24, the cage 98 can move freely on rollers 100 engaged between a collar 99 and carrying one or more cage 98.

Figure 28:
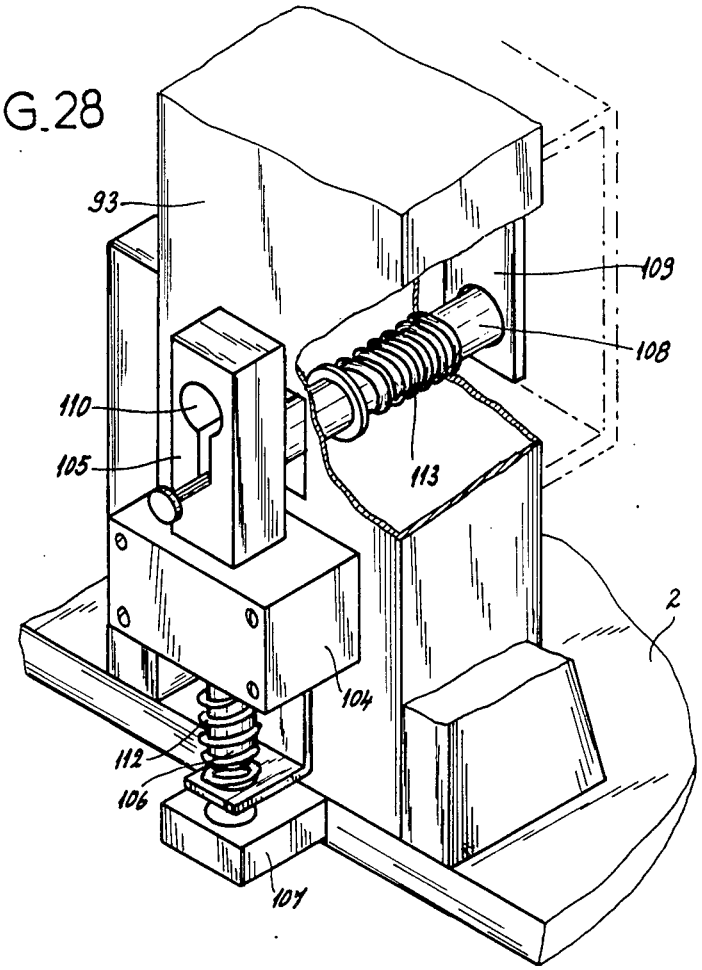
FIG. 28 is a large-scale partly broken-away perspective view of a detail of the fourth elevator.

As shown in FIG. 28 the mast 93 can be secured by means of a bolt 105 vertically slidable in a fitting 104 and having a cylindrical lower end 106 engageable as a bolt in an eye 107 on the chassis 2. In addition a latching rod 108 is provided on the mast 93 that can engage on a plate 109 carried on the carriage or cage 98. This rod 108 can only engage through the large part of a keyhole 110 when the bolt 106 is engaged in the eye 107. Springs 112 and 113 urge the bolts 106 and 108, respectively, into the engaged positions. Thus only when the mast is bolted in the erect position can the bolt 108 unlatch the platform, and vice versa on opposite motion of the mast 93.

The systems of this invention can therefore be reduced to relatively small size, but can be expanded upward to a very tall working height. They are simple in construction for trouble-free years or service and low manufacturing costs.

I claim:

1. An elevator comprising:

a horizontal chassis;

a telescopingly extensible and retractable mast having upper and lower ends and formed of interfitting inner and outer elements having respective upper and lower ends;

a guide extending along the inner element between its ends;

a platform adapted to support a worker and displaceable in the guide along the inner element between its ends;

pivot means securing the lower end of the outer element to the chassis for pivoting of the mast about a pivot axis relative to the chassis but without disconnection therefrom between an erect position with the upper ends above the lower ends and a recumbent position with the mast lying on the chassis and the mast ends generally level with each other, the axis being sufficiently above the chassis that in the recumbent position the platform can lie between the chassis and the mast;

drive means connected between the chassis and the mast for pivoting the mast about the axis from the recumbent to the erect position and thereafter vertically extending the mast and raising the platform; and latch means on the lower ends of the elements and on the chassis for blocking extension of the mast and displacement of the platform along the guide of the inner element except when the mast is in the erect position.

2. The elevator defined in claim 1 wherein the chassis has opposite ends, one of which carries the mast and pivot means, the mast having a center of mass horizontally between the pivot axis and the other chassis end.

3. The elevator defined in claim 1 wherein the drive means includes a motor mounted on the chassis and having a drum; and a cable connected between the drum and the mast.

4. The elevator defined in claim 3 wherein the mast is formed of a interfitting inner and outer elements having respective upper and lower ends, the drive means including deflector wheels at the upper end of each element, the cable passing over the wheel of the outer element and having an end attached to the lower end of the inner element, the drive means including another cable having one end connected to the upper end of the outer element, passing over the wheel of the inner element, and having an other end connected to the platform, whereby winding in the cable raises the platform and generally simultaneously extends the mast.

5. The elevator defined in claim 3 wherein the drive means includes a deflector wheel outboard of the mast, whereby winding in the cable erects the mast before extending it.

6. The elevator defined in claim 3 wherein the drive means includes deflector wheels at the upper and lower end of each element, the cable passing over and under these wheels and having an end attached to the platform, whereby winding in the cable raises the platform and thereafter pulls up the mast elements.

7. The elevator defined in claim 6 wherein the chassis is provided with a guide portion underneath the guide and aligned therewith in the erect mast position.

8. The elevator defined in claim 1, further comprising manually releasable second latch means for blocking the mast from pivoting on the chassis when in the erect position.

9. The elevator defined in claim 8 wherein the second latch means is connected to the first-mentioned latch means for unblocking the mast after same is in the erect position and the second latch means has blocked pivoting of the mast.

10. The elevator defined in claim 1 wherein the chassis has two opposite ends each provided with one such mast, the axes of the masts being generally parallel but the masts being offset axially relative to each other so they can lay next to each other in the recumbent position.

11. The elevator defined in claim 10 wherein the platform is provided with carriages riding in the guides and is pivoted on these carriages about axes parallel to the mast pivot axes.

12. The elevator defined in claim 11 wherein the drive means includes a motor mounted on the chassis and having at least one drum;

respective cables connected between the drum and the mast, the mast being formed of interfitting inner and outer elements having respective upper and lower ends; and deflector wheels at the upper and lower end of each element, the cable passing over and under these wheels and having an end attached to the carriages, whereby winding in the cable raises the platform and thereafter pulls up the mast elements.

13. The elevator defined in claim 12, further comprising means including a lost-motion slide joint between the cable end and the platform for permitting limited raising of the platform relative to the cable end.

14. An elevator comprising:

a horizontal chassis;

a telescopingly extensible and retractable mast having upper and lower ends and formed of interfitting inner and outer elements having a respective upper and lower ends;

a guide extending along the inner element between its ends;

a platform adapted to support a worker and displaceable in the guide along the mast between its ends;

pivot means securing the lower end of the outer element to the chassis for pivoting of the mast about a pivot axis relative to the chassis between an erect position with the upper ends above the lower ends and a recumbent position with the mast lying on the chassis and the mast ends generally level with each other, the axis being sufficiently above the chassis that in the recumbent position the platform can lie between the chassis and the mast;

drive means connected between the chassis and the mast for pivoting the mast about the axis from the recumbent to the erect position and thereafter vertically extending the mast and raising the platform; and latch means on the mast and chassis for blocking extension of the mast and displacement of the platform along the guide of the inner element except when the mast is in the erect position, the latch means including a locking bolt engageable through the mast elements, and actuation means on the chassis for pushing it out of such engagement when the mast is erect.

15. The elevator defined in claim 14 wherein the latch means includes a spring urging the locking bolt into engagement through the mast elements, the actuation means including an abutment engageable with the bolt opposite to the direction of the spring force in the erect position of the mast.

16. An elevator comprising:

a horizontal chassis having two opposite ends;

respective telescopingly extensible and retractable masts at the chassis ends having upper and lower ends and formed of interfitting inner and outer elements having respective upper and lower ends;

a guide extending along the inner element between its ends;

a platform adapted to support a worker and displaceable in the guide along the mast between its ends;

pivot means securing the lower end of the outer element to the chassis for pivoting of the mast about a pivot axis relative to the chassis between an erect position with the upper ends above the lower ends and a recumbent position with the mast lying on the chassis and the mast ends generally level with each other, the axis being sufficiently above the chassis that in the recumbent position the platform can lie between the chassis and the mast;

drive means connected between the chassis and the mast for pivoting the mast about the axis from the recumbent to the erect position and thereafter vertically extending the mast and raising the platform, the axes of the masts being generally parallel but the masts being offset axially relative to each other so they can lay next to each other in the recumbent position; and crutch means connectable to the lower ends of the masts and rigidly securable thereto, the crutch means extending in the recumbent position horizontally past the chassis and in the erect position downward past the chassis, whereby pivoting of the masts from the recumbent to the erect position lifts the chassis up by means of the crutches.

17. The elevator defined in claim 16 wherein the crutches have outer ends provided with rollers and are also securable in the erect mast position to the chassis, whereby when thus secured to the chassis and disconnected from the masts same can be moved into the recumbent position without dropping the chassis.

* * * * *